US005349827A

United States Patent [19]

Bracque et al.

[11] Patent Number: 5,349,827

[45] Date of Patent: Sep. 27, 1994

[54] PROCESS FOR THE CONSTRUCTION OF A CRYOGENIC UNIT FOR THE SEPARATION OF GAS, CRYOGENIC UNIT, SUBASSEMBLY AND TRANSPORTABLE ASSEMBLY FOR THE CONSTRUCTION OF SUCH A UNIT

[75] Inventors: Gilles Bracque, Saint Leu Desserent; Francois Dehaine, Villemomble; Jean-Pierre Gourbier, Le Plessis Trevise; Alain Grelaud, La Quene-En-Brie; Alain Guillard, Paris; Michel Mouliney, St. Jean De Moiran; Norbert Rieth, Paris, all of France

[73] Assignee: L'Air Liquide, Societe Anonyme Pour L'Etude Et L'Exploitation Des Procedes Georges Claude, Paris, France

[21] Appl. No.: 74,411

[22] Filed: Jun. 10, 1993

[30] Foreign Application Priority Data

Jun. 17, 1992 [FR] France ..... 92 07327

[51] Int. Cl.[5] ..... F25J 3/00

[52] U.S. Cl. ..... 62/298; 62/36; 29/429; 29/469

[58] Field of Search ..... 62/36, 298; 29/469, 29/890.03, 429

[56] References Cited

U.S. PATENT DOCUMENTS

| | | | |
|---|---|---|---|
| 3,703,028 | 11/1972 | Bosquain et al. | 29/429 X |
| 3,750,413 | 8/1973 | Milligan et al. | 62/42 |
| 4,064,616 | 12/1977 | Kubota et al. | 29/429 |
| 4,432,128 | 2/1984 | Pechacek et al. | 29/429 |
| 5,205,042 | 4/1993 | Greter et al. | 33/365 |

FOREIGN PATENT DOCUMENTS 1576945 8/1969 France .

*Primary Examiner*—Henry A. Bennet
*Assistant Examiner*—Christopher Kilner
*Attorney, Agent, or Firm*—Young & Thompson

[57] ABSTRACT

A cryogenic unit for the separation of gases includes at least one distillation column (1) is preassembled in the factory. The column (1) with added tubing elements (2) constitutes a pre-equipped subassembly which is transported and installed at the worksite. The tubing elements are disposed so as to be inscribed in at least one elongated volume (3; $3_1$, $3_2$) lateral to the column and of reduced section. The subassembly (1,2) is disposed on at least one transport cradle (4, 4') and transported to the worksite on the cradle and mounted at the worksite in a cold box (10) Preferably, all the tubing elements are disposed in the cradle. The subassembly, with or without the cradle, is mounted adjacent one side wall of the cold box (10) and is spaced by insulation (13) from at least one liquid gas reservoir (11; 12) also in the cold box (10).

8 Claims, 1 Drawing Sheet

PROCESS FOR THE CONSTRUCTION OF A CRYOGENIC UNIT FOR THE SEPARATION OF GAS, CRYOGENIC UNIT, SUBASSEMBLY AND TRANSPORTABLE ASSEMBLY FOR THE CONSTRUCTION OF SUCH A UNIT

The present invention relates to processes for the construction of cryogenic units for the separation of gases, typically air gases, comprising at least one distillation column and including the steps of preassembling in the factory the column with its added tubing elements including instrumentation tubing to constitute a pre-equipped subassembly, transporting and installing this subassembly at the worksite.

Conventionally, cryogenic units for the separation of gases comprise at least one distillation column which is disposed in an insulating structure called a cold box having usually a substantially parallelepipedal shape so as to provide about the column a predetermined thickness of insulation. With a view toward limiting the costs of mounting and above all with a view to quality, the column is preassembled with tubing elements in a factory of the builder with a framework corresponding to that of the future cold box, and of a cross section integrating the future insulation thicknesses all about the column, before transporting and installing the assembly at the worksite, a so-called "cold box package". Apart from their weight, sharply driving up the cost of transportation, such completely preassembled assemblies are confronted, largely because of their great volume, with serious transportation problems (bridge clearance, cornering . . . ), as mentioned on page 25 of the 1989 Annual Report of the Linde company, when the dimensions of the column are great, as is the case nowadays for massive production of gas.

The present invention has for its object to provide a process permitting maintaining the quality criteria of preassembly in the factory of the elements requiring high quality control (typically all the cryogenic part), greatly limiting the problems and the costs of transport toward the utilization site and facilitating its installation on site in various types of cold boxes.

To do this, according to a characteristic of the invention, the construction process comprises the steps of forming the subassembly pre-equipped with the tubing elements so arranged as to be inscribed within at least one, and preferably only one, elongated volume lateral to the column and of reduced section, not taking account of the insulating thickness required for the operation of the column on the site, having typically a maximum width not or only a little exceeding the diameter of the column, disposing this subassembly on at least one transport cradle, preferably a single transport cradle defining an internal volume of a cross section adapted to receive at least one of the lateral volumes corresponding to the tubing elements, transporting the subassembly and its cradle and mounting at the worksite the subassembly in a cold box, then applying the thickness of insulation required all about the subassembly.

According to other characteristics of the invention:

the process comprises the step of protecting the tubing elements by a cap;

the pre-equipped subassembly is disposed partially in a transport cradle defining an interior volume of a cross section adapted to receive at least one of the lateral volumes of the tubing elements;

the tubing elements are regrouped into a lateral volume, this subassembly being disposed in the cradle with the column resting on the upper portion of the cradle;

the process comprises the steps of mounting at the worksite the subassembly in a casing in which is also disposed at least one reservoir of cryogenic liquid and filling the casing with a first insulation;

the subassembly is disposed in the casing with the lateral volume adjoining one lateral wall of the casing at a distance of this latter sufficient to restore the necessary insulation distance.

Such a process, no longer taking account, for its preassembly and transport, of the volume of insulation necessary to the column, permits increasing the possibilities of transport of a subassembly of a cryogenic unit in quasi operating condition, including as the case may be the functions of supervision, control and security, while diminishing the overall dimensions, as well as the number of structural elements of the cradle, particularly for units of high capacity with column diameters between 2 and 5.5 meters.

The present invention also has for its object a subassembly for carrying out the process, characterized in that the column is preassembled with tubing elements disposed so as to be inscribed within at least one elongated volume lateral to the column, of reduced section, typically a single lateral volume adapted to be received in a cradle for transport and/or mounting.

The present invention has for another object a transportable assembly comprising such a subassembly mounted on a transport cradle, preferably disposed partially in a cradle sheltering the lateral volume of the tubing elements and supporting the column along the generatrices of this latter.

The present invention has further for its object a new architecture of cryogenic unit for the production of gases, particularly from air, comprising a subassembly such as that defined above disposed adjacent a lateral wall of a casing, typically cylindrical or if desired prismatic, in which is also disposed at least one reservoir of liquified gas, the casing being filled with at least one insulation, especially a particulate or fibrous material.

Other characteristics and advantages of the present invention will become apparent from the following description of embodiments, given by way of illustration but in no way limiting, with respect to the accompanying drawing, in which.

Figure 1:
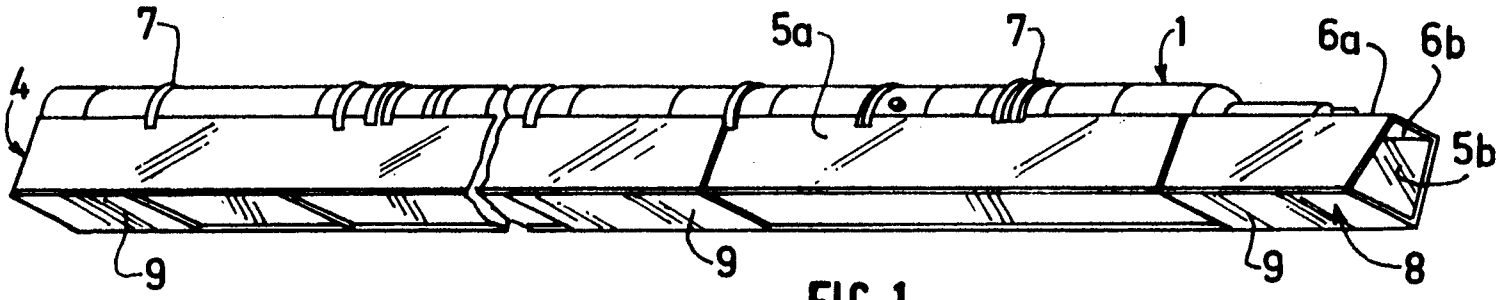
FIG. 1 is a schematic perspective view of a transportable assembly of a subassembly of pre-equipped column and a transport cradle according to an embodiment of the invention.

In FIG. 1 is shown a column 1 for the distillation of air gases whose diameter can be as much as 5.5 meters and the height 50 meters. As is better seen in FIG. 2, the column 1 is arranged and preassembled such that the different tubing elements 2 which fit into it will be disposed on one lateral side of the column so as to be inscribed within a lateral elongated volume 3 whose maximum width is limited to or only a little exceeds the maximum diameter of the column and whose height h is independent of the thickness of insulation ultimately required for the operation on the worksite of the column 1 in its cold box. According to the invention, once tested, the column 1 and its tubing elements 2 are mounted in a cradle 4 of generally prismatic configuration and with a typically trapezoidal cross section to offer an increased base surface, comprising two lateral flanges 5A, 5B, defining an internal volume adapted to receive the lateral volume 3 of the tubing elements 2, the column bearing, along generatrices, substantially below or at the level of its horizontal diameter, on the parallel edges 6A, 6B of the flanges 5A, 5B and being maintained in position on the cradle for example by encircling straps 7. The cradle 4 has a frame constituting a trellis of angle irons or of tubes. In a preferred embodiment, the cradle 4 comprises flat lateral flanges 5A, 5B formed by metallic plates, at least one portion of the base 8 of the cradle 4 being constituted by metallic plates 9.

Figure 2:
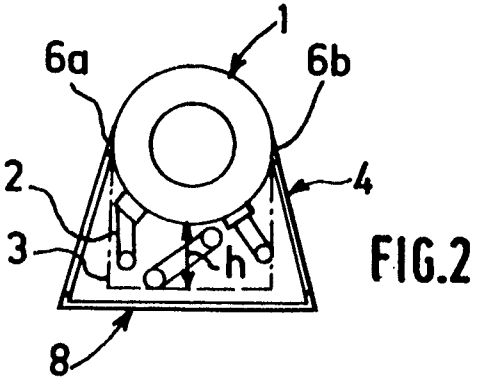
FIG. 2 is a schematic view in transverse cross section of the assembly of FIG. 1.

It will thus be seen from FIG. 2 that with respect to the existing transportable assemblies, the size of the transportable assembly according to the invention is limited to that of the cradle 4 and the upper cylindrical portion of the column 1.

Figure 3:
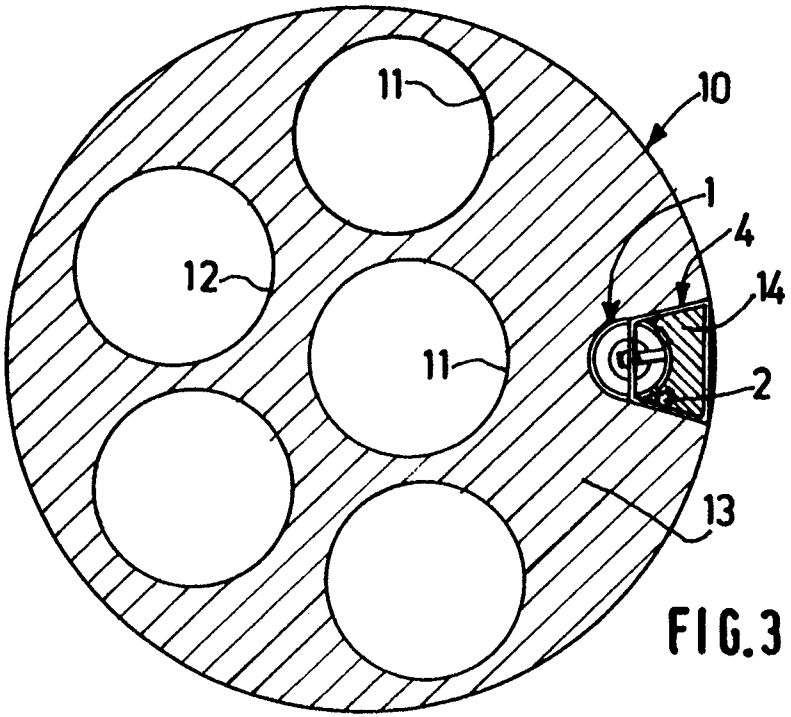
FIG. 3 is a schematic elevational view of a cryogenic unit according to the invention comprising a subassembly of a pre-equipped column according to FIGS. 1 and 2.

As will be seen in FIG. 3, according to another aspect of the invention, instead of being disposed in a parallelepipedal cold box at a distance from insulated independent reservoirs of liquified gas, the column 1 is disposed vertically in an internal space available in a cylindrical or polygonal casing 10, of metal or concrete, in which are disposed several uninsulated or individually insulated vertical reservoirs 11, 12, for storage of cryogenic liquid, typically liquid nitrogen and liquid oxygen produced by the column 1. This latter is disposed, with its cradle 4, in the casing 10 in a position facing the lateral wall of casing 10 and the reservoirs 11, 12 permitting retaining the insulation distance necessary for its good functioning. It is thus positioned on the base of the envelope 10 and the tubing elements 2 are connected to fluid circuits internal and external to the casing 10, particularly for the connection of heat exchangers. The cradle 4 can be dismounted and reused and, before closure (by a cover) of the casing 10, the internal volume of this latter is filled with solid insulation 13, typically perlite.

According to a modification of the invention, the cradle 4 is maintained in the casing and, in the embodiment in which its lateral flanges 5A, 5B are flat, the internal volume of the cradle is filled with a second solid insulation 14, for example glass fibers.

Figure 4:
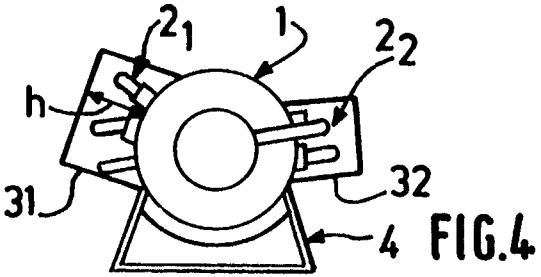
FIG. 4 is a view similar to FIG. 2, of a modified embodiment of transportable assembly according to the invention.

As a variation, and particularly for high columns but of a diameter not exceeding 4.5 meters, the added tubing elements 2 can be disposed in two groups inscribed in two lateral volumes of sections reduced as much as possible, particularly in thickness. There is thus shown in FIG. 4, a subassembly in which the tubing elements, including the instrumentation tubing, are assembled in two groups $2_1$, $2_2$ bisymmetric with each other in a vertical plane (in FIG. 4). The lateral volumes in which are inscribed the tubing elements are embodied here in protective caps 31 and 32, for example of sheet metal, mounted on the column and ensuring their protection during transport and the emplacement at the worksite of the subassembly, after which the caps are removed. One of these caps can be reinforced to constitute a transport cradle, as previously seen in connection with FIGS. 1 and 2. However, one of the critical parameters for the transport being the overall height (and particular for the passage below bridges or electric lines), there will preferably be disposed, as shown in FIG. 4, the pre-equipped and protected subassembly 1, $2_1$, $2_2$, 31, 32 on a cradle 4' of a height reduced to the strict minimum and of suitable shape.

Although the present invention has been described in connection with particular embodiments, it is not thereby limited but is on the contrary susceptible to modifications and variations which will be apparent to one skilled in the art.

What is claimed is:

1. In a process for the construction of a cryogenic unit for the separation of gases including at least one distillation column (1), comprising the steps of preassembling in a factory a said column (1) with added tubing elements (2) to constitute a pre-equipped subassembly, and transporting and installing the subassembly at a worksite; the improvement comprising constituting the pre-equipped subassembly with tubing elements disposed so as to be inscribed in at least one elongated volume (3; $3_1$, $3_2$) lateral to the column, and disposing the subassembly (1, 2) on at least one transport cradle (4, 4'), transporting the subassembly and its cradle to the worksite and mounting at the worksite the subassembly in a cold box (10).

2. Process according to claim 1, further comprising the step of protecting the tubing elements by a cap (4; $3_1$, $3_2$).

3. Process according to claim 1, wherein the preequipped subassembly (1, 2) is partially disposed in a transport cradle (4) with at least one of the lateral volumes (3) of tubing elements (2) disposed in said cradle (4).

4. Process according to claim 3, wherein all the tubing elements (2) are disposed in the cradle (4) with the column (1) resting on an upper portion of the cradle (4).

5. Process according to claim 1, further comprising mounting at the worksite the subassembly (1, 2) in a casing comprising said cold box (10) in which is also disposed at least one reservoir of cryogenic liquid (11; 12), and filling the casing with a first insulation (13).

6. Process according to claim 5, wherein the subassembly (1, 2) is disposed in the casing (10) with the lateral volume (3) adjacent a lateral wall of the casing at a distance of this latter sufficient to retain a necessary insulation distance from said at least one reservoir (11; 12).

7. Process according to claim 6, wherein the subassembly (1, 2) is mounted in the casing (10) with its cradle (4).

8. Process according to claim 7, wherein the cradle (4) comprises lateral substantially flat flanges (5A, 5B) and in that the internal volume of the cradle is filled, in the casing (10), with a second insulation (14).

* * * * *